US009927101B2

(12) United States Patent
Anami

(10) Patent No.: US 9,927,101 B2
(45) Date of Patent: Mar. 27, 2018

(54) ILLUMINATION DEVICE

(71) Applicant: PANASONIC INTELLECTUAL PROPERTY MANAGEMENT CO., LTD., Osaka (JP)

(72) Inventor: Shinichi Anami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 33 days.

(21) Appl. No.: 15/177,644

(22) Filed: Jun. 9, 2016

(65) Prior Publication Data

US 2016/0377268 A1 Dec. 29, 2016

(30) Foreign Application Priority Data

Jun. 25, 2015 (JP) ..... 2015-127901

(51) Int. Cl.

| | |
|---|---|
| ***F21V 9/16*** | (2006.01) |
| ***F21V 19/02*** | (2006.01) |
| ***F21V 7/22*** | (2018.01) |
| ***F21V 5/04*** | (2006.01) |
| ***F21V 29/89*** | (2015.01) |
| ***F21V 29/74*** | (2015.01) |
| ***F21V 23/00*** | (2015.01) |
| ***F21V 14/08*** | (2006.01) |
| ***F21V 14/04*** | (2006.01) |
| *F21W 131/405* | (2006.01) |

(52) U.S. Cl.

CPC ..... *F21V 19/02* (2013.01); *F21V 5/04* (2013.01); *F21V 7/22* (2013.01); *F21V 9/16* (2013.01); *F21V 14/04* (2013.01); *F21V 14/08* (2013.01); *F21V 23/009* (2013.01); *F21V 29/74* (2015.01); *F21V 29/89* (2015.01); *F21W 2131/405* (2013.01)

(58) Field of Classification Search

CPC ..... G02B 6/0068
USPC ..... 362/84, 231
See application file for complete search history.

(56) References Cited

U.S. PATENT DOCUMENTS 7,327,408 B1 * 2/2008 Berman ..... G02B 27/28 348/744

FOREIGN PATENT DOCUMENTS

| | | |
|---|---|---|
| JP | 2001-184934 A | 7/2001 |
| JP | 2010-025469 A | 2/2010 |
| JP | 2012-178319 A | 9/2012 |
| JP | 2013-101793 A | 5/2013 |
| JP | 2014-175126 A | 9/2014 |

* cited by examiner

*Primary Examiner* — Jamara Franklin
(74) *Attorney, Agent, or Firm* — Greenblum & Bernstein, P.L.C.

(57) ABSTRACT

An illumination device includes a light source configured to emit laser light; and a wavelength conversion part configured to convert a wavelength of the laser light emitted from the light source and to irradiate illumination light. The wavelength conversion part includes a conversion region provided with a phosphor which converts the wavelength of the laser light and emits the wavelength-converted laser light, and a non-conversion region not provided with the phosphor and configured to transmit the laser light irradiated from the light source. The non-conversion region is formed in a pinhole shape with respect to the conversion region.

7 Claims, 5 Drawing Sheets

ILLUMINATION DEVICE

CROSS-REFERENCE TO RELATED APPLICATIONS

This application claims priority to Japanese Patent Application No. 2015-127901, filed Jun. 25, 2015, the entire contents of which are hereby incorporated by reference.

TECHNICAL FIELD

The disclosure relates to an illumination device which uses laser light as a light source.

BACKGROUND ART

In the related art, a spotlight type illumination device is used in a show window or a museum to illuminate an object. In the spotlight type illumination device of the related art, a HID (High Intensity Discharge) lamp or the like capable of irradiating illumination light at high output power has been widely used as a light source. In recent years, there is known an illumination device which uses, as a light source, a semiconductor laser capable of emitting light at high efficiency and high output power (see, e.g., Japanese Unexamined Patent Application Publication No. 2014-175126).

When using the spotlight type illumination device, it is necessary to appropriately adjust an irradiation direction of illumination light in order to effectively illuminate an object. However, depending on the kind of an object, there may be a case where it is difficult to grasp an irradiation range due to surface irregularities or reflection characteristics and to appropriately adjust an irradiation direction of illumination light. Thus, there is known an illumination device in which a laser pointer is detachably attached to a front opening that emits illumination light (see, e.g., Japanese Unexamined Patent Application Publication No. 2001-184934).

The illumination device disclosed in Japanese Unexamined Patent Application Publication No. 2001-184934 is not suitable for use as a spotlight type illumination device because, for example, if the irradiation direction of illumination light is changed frequently, the laser pointer needs to be detached and attached each time when the irradiation direction of illumination light is changed. Furthermore, in addition to a main light source for illuminating an object, it is necessary to additionally use a laser light source for the laser pointer. Consequently, there is a possibility that the number of components such as lighting circuits of individual light sources and the like increases and the configuration of the illumination device becomes complex.

SUMMARY OF THE INVENTION

In view of the above, the present disclosure provides an illumination device capable of easily adjusting an irradiation direction of illumination light with a simple configuration.

In accordance with an aspect, there is provided an illumination device, including: a light source configured to emit laser light; and a wavelength conversion part configured to convert a wavelength of the laser light emitted from the light source and to irradiate illumination light, wherein the wavelength conversion part includes a conversion region provided with a phosphor which converts the wavelength of the laser light and emits the wavelength-converted laser light, and a non-conversion region not provided with the phosphor and configured to transmit the laser light irradiated from the light source, and the non-conversion region is formed in a pinhole shape with respect to the conversion region.

According to the present disclosure, when the light emitted from the illumination device is irradiated toward an object, not only the illumination light emitted from the conversion region but also the laser light emitted from the non-conversion region is projected on the irradiated surface of the object. Unlike the conversion region, the non-conversion region is formed in a pinhole shape. Therefore, the laser light emitted from the non-conversion region is projected on the irradiated surface just like a laser pointer. Thus, by referring to the laser light when illuminating an object, a user or other person can easily adjust the irradiation direction of illumination light. In addition, laser light easily identifiable by a user or other person can be emitted in a light color differing from that of illumination light using a simple configuration provided with the non-conversion region.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Figure 1A:
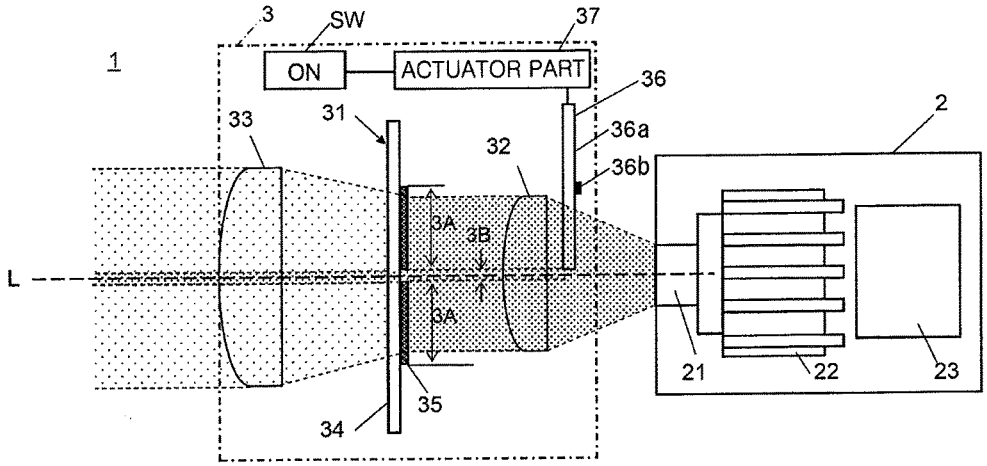
FIG. 1A is a side configuration view showing a switch-on state of an illumination device according to one embodiment.

An illumination device according to one embodiment of the present invention will be described with reference to FIGS. 1A to 5B. As illustrated in FIG. 1A, the illumination device 1 of the present embodiment includes a light source 2 which emits laser light and a wavelength conversion part 3 which converts the wavelength of the laser light emitted from the light source 2 and irradiates illumination light. In the illustrated example, there is shown a configuration in which laser light is directly propagated from the light source 2 to the wavelength conversion part 3. As an alternative example, the light source 2 and the wavelength conversion part 3 may be provided in the positions spaced apart from each other and the laser light may be propagated through an optical fiber (not shown) disposed between the light source 2 and the wavelength conversion part 3.

The light source 2 includes a semiconductor laser element 21, a heat dissipation part 22 for dissipating heat generated during the operation of the semiconductor laser element 21, and a lighting control circuit 23 for lighting the semiconductor laser element 21. A laser element configured to emit blue light having a wavelength of, for example, 440 nm to 455 nm, is used as the semiconductor laser element 21. The heat dissipation part 22 is made of a metal having high heat dissipation, such as an aluminum alloy or the like. A general-purpose die-cast member provided with fins for improving heat dissipation is used as the heat dissipation part 22. The lighting control circuit 23 includes a rectifier transformer circuit (not shown) which converts an electric current received from a commercial power source (not shown) to a direct current and controls a voltage applied to control the output of the semiconductor laser element 21 to correspond to a predetermined output control signal.

The wavelength conversion part 3 includes a phosphor plate 31 configured to convert the wavelength of the laser light coming from the light source 2 and to emit the wavelength-converted laser light. The wavelength conversion part 3 further includes a first optical member 32 which controls light distribution of the laser light incident on the phosphor plate 31 and a second optical member 33 which controls light distribution of the illumination light emitted from the phosphor plate 31. The first optical member 32 is a condenser lens. The first optical member 32 converts the laser light emitted from the light source 2 to substantially parallel light and emits the substantially parallel light toward the phosphor plate 31. The second optical member 33 is also a condenser lens. In the case where the illumination device 1 is of a spotlight type, the second optical member 33 controls light distribution of the illumination light emitted from the phosphor plate 31. In addition to the first optical member 32 and the second optical member 33, various kinds of optical system members may be appropriately installed on the optical paths of the laser light and the illumination light.

Figure 1B:
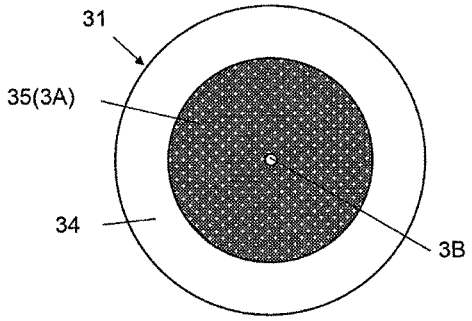
FIG. 1B is a front view of a wavelength conversion part (phosphor plate) used in the illumination device.

As illustrated in FIG. 1B, the phosphor plate 31 includes a substrate 34 and a phosphor 35 disposed on the substrate 34 and configured to convert the wavelength of the laser light coming from the light source 2 and to emit the wavelength-converted laser light. The phosphor 35 is formed in a circular film shape when viewed from the front side and is configured to define a conversion region 3A. A region where the phosphor 35 is not provided becomes a non-conversion region 3B which transmits the laser light emitted from the light source 2.

Unlike the film-shaped conversion region 3A, the non-conversion region 3B is formed in a circular pinhole shape. Furthermore, the non-conversion region 3B is provided at a position in which when it is disposed on the optical axis L of the laser light emitted from the light source 2, the non-conversion region 3B becomes the center of the irradiation region of the laser light in the phosphor plate 31 (the wavelength conversion part 3).

For example, a crystalline substrate made of glass, quartz, sapphire or the like or a sintered body substrate made of spinel or the like may be used as the substrate 34. Since the material such as quartz, sapphire or the like is high in heat conductivity and superior in heat dissipation, it is particularly preferable to use the material such as quartz, sapphire or the like. For example, a yellow phosphor excited by blue laser light to emit yellow light may be used as the phosphor 35.

In the illumination device 1 configured as above, the laser light emitted from the light source 2 is irradiated on the phosphor plate 31 through the first optical member 32. A portion of the laser light incident on the conversion region 3A of the irradiated region is converted to yellow light by the phosphor 35. White illumination light obtained by mixing the blue laser light and the yellow light is emitted from the conversion region 3A. On the other hand, the phosphor 35 is not provided in the non-conversion region 3B. Therefore, the laser light irradiated toward the phosphor plate 31 and incident on the non-conversion region 3B is emitted from the phosphor plate 31 while maintaining a blue color. The white illumination light and the blue laser light are emitted to the outside of the illumination device 1 through the second optical member 33.

When the light emitted from the illumination device having the aforementioned configuration is irradiated toward an object, not only the white illumination light emitted from the conversion region 3A but also the blue laser light emitted from the non-conversion region 3B is projected on the irradiated surface. Unlike the film-shaped conversion region 3A, the non-conversion region 3B is formed in a pinhole shape. Therefore, the laser light emitted from the non-conversion region 3B is projected on the irradiated surface just like a laser pointer. Thus, by referring to the blue laser light when illuminating the object, a user or other person can easily adjust the irradiation direction of the illumination light. In addition, the blue laser light easily identifiable by a user or other person can be emitted in a light color differing from that of the illumination light, by a simple configuration which includes the non-conversion region 3B defined by not forming the phosphor 35 on the phosphor plate 31, without having to use an additional pointer light source.

Furthermore, the non-conversion region 3B is provided at a position in which when it is disposed on the optical axis L of the laser light emitted from the light source 2, the non-conversion region 3B becomes the center of the irradiation region of the laser light in the phosphor plate 31. For that reason, when the light is irradiated from the illumination device 1 toward an object, the blue laser light emitted from the non-conversion region 3B is projected, at the center of the white illumination light emitted from the conversion region 3A, on the irradiated surface. Accordingly, even if it is difficult to know the irradiation range is difficult to know due to the surface irregularities or the reflection characteristics of the object, a user can easily grasp the center of the light irradiation range and easily and appropriately adjust the irradiation direction of the illumination light.

The wavelength conversion part 3 further includes a switch SW for permitting or inhibiting the emission of the laser light from the non-conversion region 3B (see FIG. 1A). The wavelength conversion part 3 further includes a light shielding part 36 which prevents the irradiation of the laser light on the non-conversion region 3B when the switch SW is not in an on-state, and an actuator part 37 which moves the light shielding part 36. The light shielding part 36 of the present embodiment includes a transparent base member 36*a* which transmits the laser light emitted from the light source 2 and a light-shielding dot portion 36*b* which is provided at a position where the light-shielding dot portion 36*b* lies at the center of the irradiation region of the laser light when the transparent base member 36*a* is disposed on the optical axis L of the laser light emitted from the light source 2. The light-shielding dot portion 36*b* is formed by, for example, coating a black dye on the transparent base member 36*a*.

When the switch SW is in an on-state, as illustrated in FIG. 1A, the actuator part 37 slidingly moves the light shielding part 36 so that the light-shielding dot portion 36*b* lies outside the irradiation region of the laser light. In this case, the laser light emitted from the light source 2 passes through the non-conversion region 3B to be irradiated together with the illumination light emitted from the conversion region 3A. Thus, the laser light serves as a laser pointer.

Figure 2:
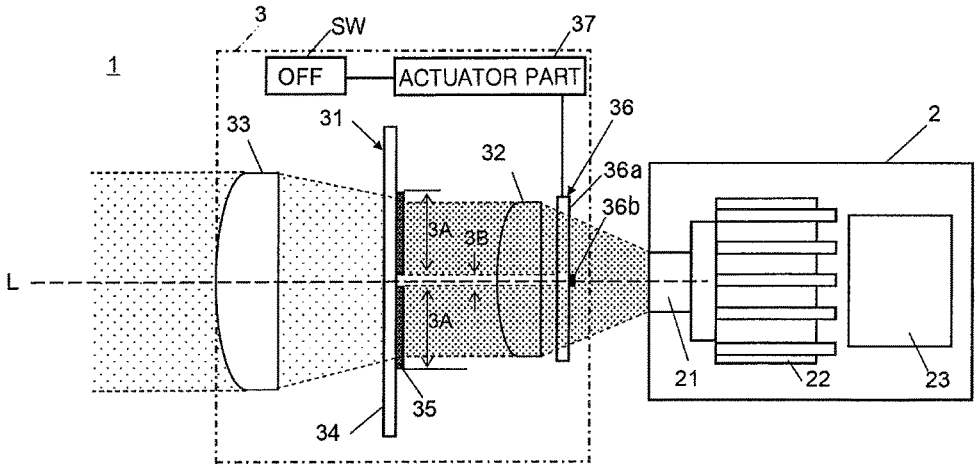
FIG. 2 is a side configuration view showing a switch-off state of the illumination device.

On the other hand, when the switch SW is not in an on-state (when the switch SW is in an off-state), as illustrated in FIG. 2, the actuator part 37 slidingly moves the light shielding part 36 so that the light-shielding dot portion 36*b* lies at the center of the irradiation region of the laser light. In this case, the laser light emitted from the light source 2 is shielded by the light-shielding dot portion 36*b*. Thus, the laser light is not incident on the non-conversion region 3B and is irradiated on only the conversion region 3A. Only the illumination light emitted from the conversion region 3A is irradiated on an object. That is to say, according to the illumination device 1, the laser light passing through the non-conversion region 3B is emitted only when the switch SW is in an on-state. Therefore, when a user or other person adjusts the irradiation direction of the illumination light or when necessary, a laser pointer can be projected on the irradiated surface (the object).

The switch SW is, for example, a button (not shown) provided near the region of a body portion (not shown) gripped by a user or other person. The switch SW comes into an on-state only when a user or other person pushes the button with a finger. When the finger is released from the button, the switch SW automatically comes into an off-state. That is to say, the laser light is emitted only when an intentional operation of pushing the button is performed by a user or other person. Thus, there is no possibility that the laser light having high output power is unintentionally emitted through the non-conversion region 3B. This helps enhance safety. In addition, it is possible to enable a user not to forget turning off the switch SW.

Furthermore, the illumination light emitted from the conversion region 3A includes the light emission of the phosphor 35. Thus, the illumination light is lower in directivity than the laser light and is slightly dispersed. Moreover, the non-conversion region 3B is formed in the shape of a pinhole far smaller than the irradiation range of the illumination light. Therefore, there is little possibility that a hole-shaped shadow on which light is not projected is generated on the object (the irradiated surface) on which the illumination light is irradiated.

Next, a modification of the aforementioned embodiment will be described with reference to FIGS. 3A and 3B. The illumination device 1 of this modification is provided with a reflector 36*c* having a triangular pyramid shape instead of the light-shielding dot portion 36*b* of the aforementioned embodiment. The reflector 36*c* may be formed by, for example, coating a reflective metal film on a base member having a triangular pyramid shape through a plating process or a vapor deposition process. Alternatively, the reflector 36*c* may be a prism made of the same material as the transparent base member 36*a*.

Figure 3A:
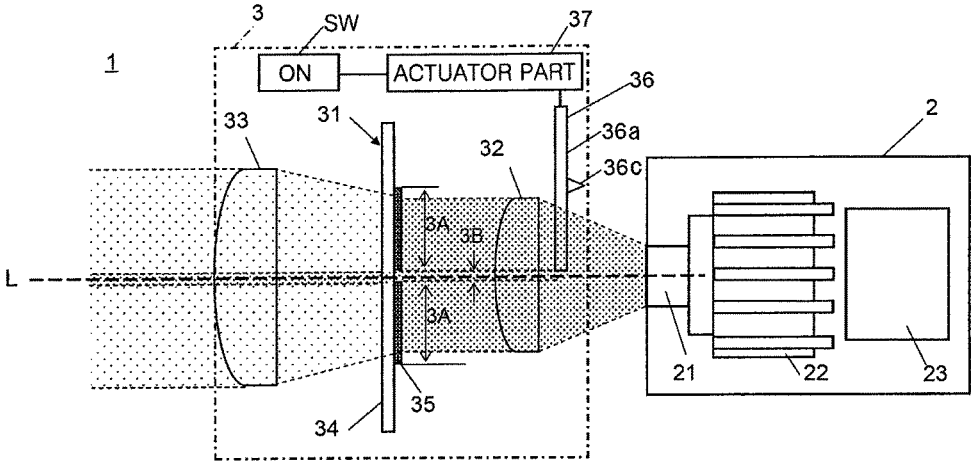
FIG. 3A is a side configuration view showing a switch-on state of an illumination device according to a modification of the aforementioned embodiment.

As illustrated in FIG. 3A, when the switch SW is in an on-state, the reflector 36*c* lies outside the irradiation region of the laser light as in the aforementioned embodiment. Thus, both the laser light passing through the non-conversion region 3B and the illumination light emitted from the conversion region 3A are irradiated on an object.

Figure 3B:
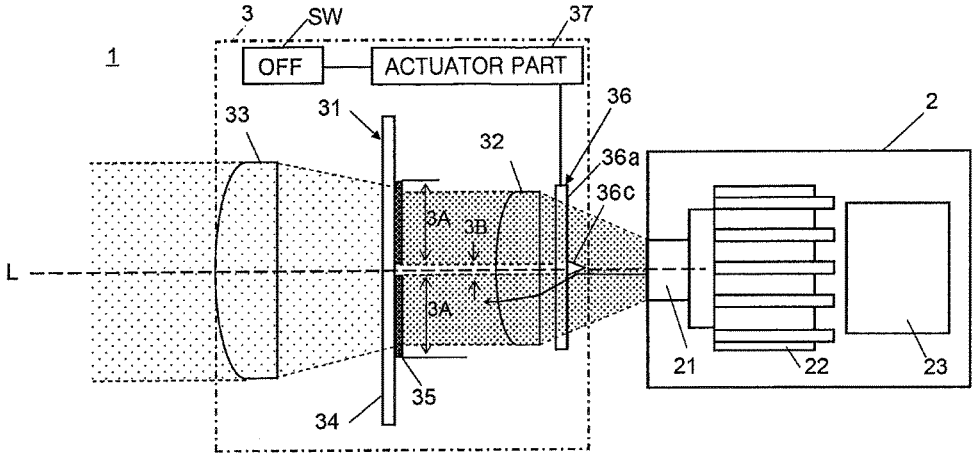
FIG. 3B is a side configuration view showing a switch-off state of the illumination device.

On the other hand, when the switch SW is not in an on-state (when the switch SW is in an off-state), as illustrated in FIG. 3B, the actuator part 37 slidingly moves the light shielding part 36 so that the reflector 36*c* is moved to the center of the irradiation region of the laser light. At this time, a part of the laser light emitted from the light source is reflected by the reflector 36*c* having a triangular pyramid shape. Thus, a part of the laser light is not incident on the non-conversion region 3B and is irradiated toward the conversion region 3A together with the remaining laser light. Only the illumination light emitted from the conversion region 3A is irradiated on an object. According to this configuration, as compared with the light-shielding dot portion 36*b*, it is possible to suppress irradiation of the laser light on the non-conversion region 3B while reducing a loss of the laser light.

Next, another modification of the aforementioned embodiment will be described with reference to FIGS. 4A and 4B. In the illumination device 1 according to this modification, when the switch SW is not in an on-state, the actuator part 37 moves the non-conversion region 3B of the phosphor plate 31 to the outside of the irradiation region of the laser light irradiated from the light source 2.

Figure 4A:
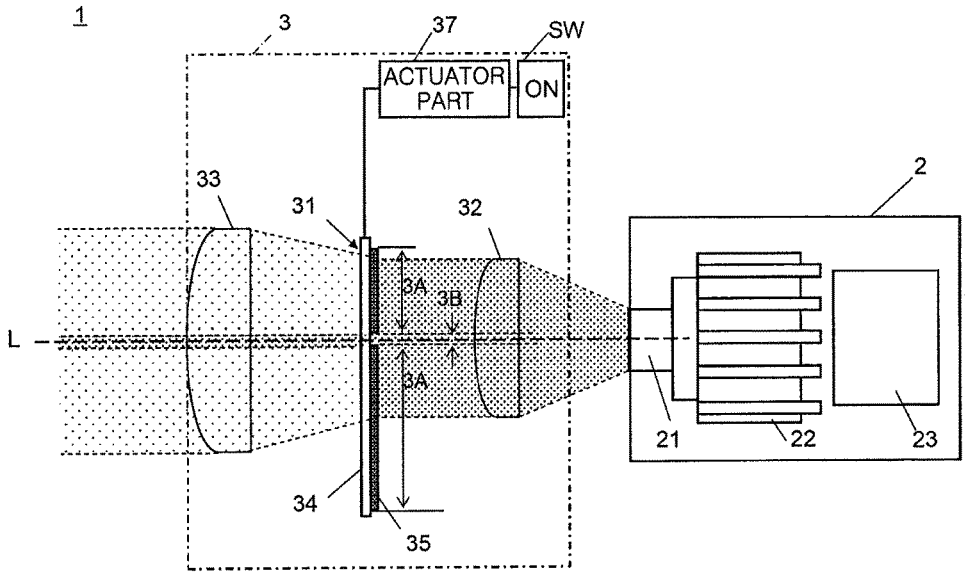
FIG. 4A is a side configuration view showing a switch-on state of an illumination device according to another modification of the aforementioned embodiment.
Figure 4B:
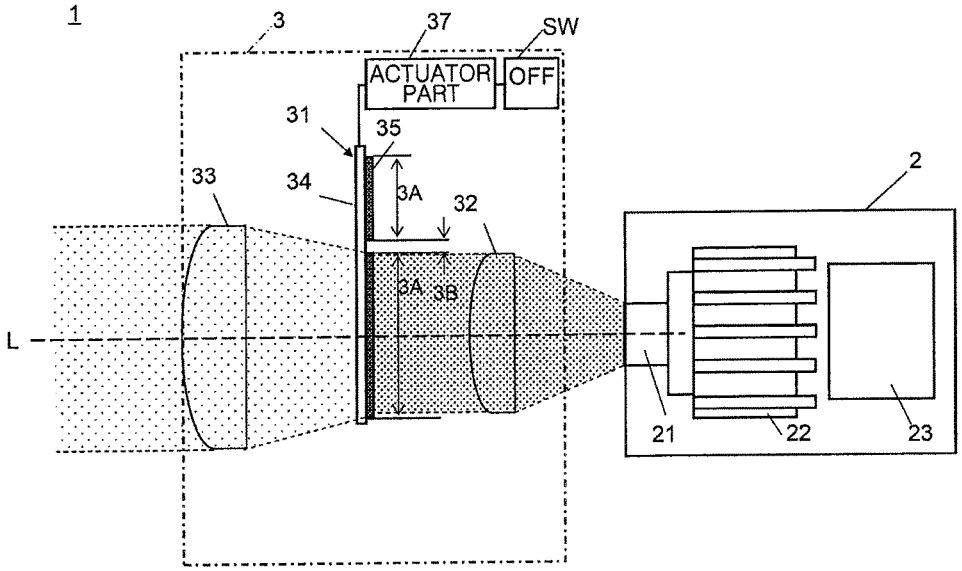
FIG. 4B is a side configuration view showing a switch-off state of the illumination device.

As illustrated in FIG. 4A, the illumination device 1 according to this modification does not include a configuration corresponding to the light shielding part 36 of the aforementioned embodiment and the aforementioned modification. Instead, the phosphor plate 31 is moved. In the phosphor plate 31, the conversion region 3A provided with the phosphor 35 is larger in size than the conversion region 3A of the aforementioned embodiment and the aforementioned modification and is formed in the phosphor plate 31 at such a size as to cover the irradiation region of the laser light emitted from the first optical member 32. The non-conversion region 3B is provided at a position offset from the center of the conversion region 3A.

When the switch SW is in an on-state, similar to the aforementioned embodiment, both the laser light passing through the non-conversion region 3B and the illumination light emitted from the conversion region 3A are irradiated on an object. On the other hand, when the switch SW is not in an on-state (when the switch SW is in an off-state), as illustrated in FIG. 4B, the actuator part 37 slidingly moves the phosphor plate 31 so that the non-conversion region 3B is moved to the outside of the irradiation region of the laser light irradiated from the light source 2 through the first optical member 32. At this time, the laser light emitted from the light source 2 is not incident on the non-conversion region 3B, which falls outside the irradiation range, and is irradiated on only the conversion region 3A. Thus, only the illumination light emitted from the conversion region 3A is irradiated on an object. According to this configuration, as compared with a case where the light-shielding dot portion 36*b* is used, it is possible to suppress irradiation of the laser light on the non-conversion region 3B while reducing a loss of the laser light.

Next, a further modification of the aforementioned embodiment will be described with reference to FIGS. 5A and 5B. In the illumination device 1 according to this modification, the light shielding part 36 includes a reflection portion 36*d* which reflects the laser light emitted from the non-conversion region 3B toward the conversion region 3A when the switch SW is not in an on-state.

Figure 5A:
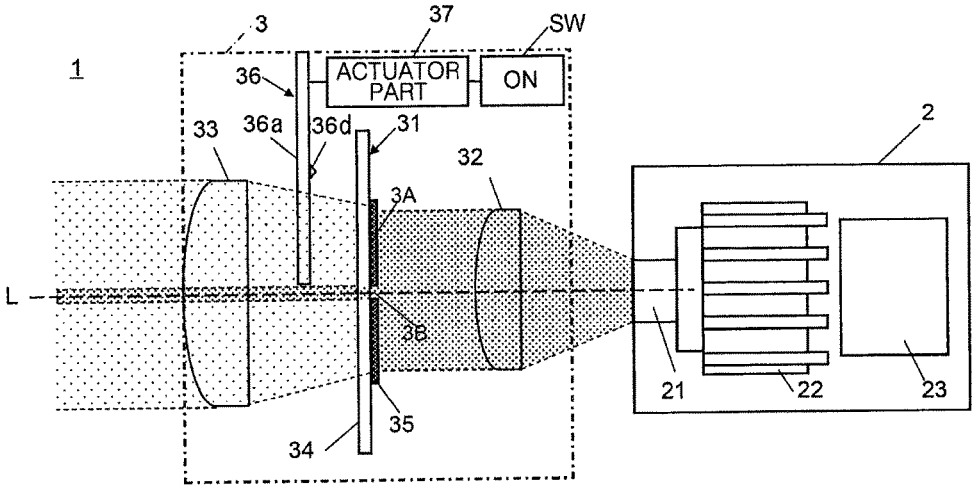
FIG. 5A is a side configuration view showing a switch-on state of an illumination device according to a further modification of the aforementioned embodiment.
Figure 5B:
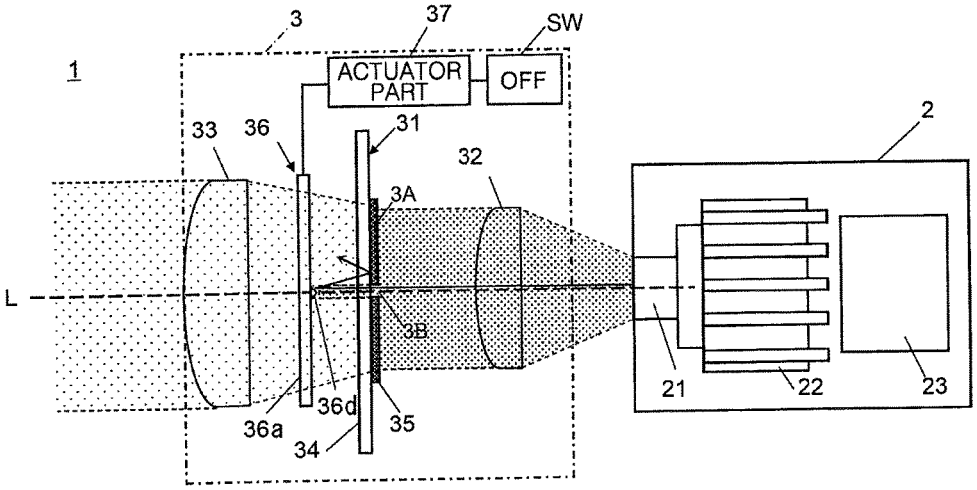
FIG. 5B is a side configuration view showing a switch-off state of the illumination device.

As illustrated in FIG. 5A, in this modification, the light shielding part 36 is disposed between the phosphor plate 31 and the second optical member 33 at the light emission side of the phosphor plate 31 and can be slid by the actuator part 37. The reflection portion 36*d* of the light shielding part 36 is provided at a position in which when the reflection portion 36*d* formed on the transparent base member 36*a* is disposed on the optical axis L of the laser light emitted from the light source 2, the reflection portion 36*d* becomes the center of the irradiation region of the laser light.

When the switch SW is in an on-state, similar to the aforementioned embodiment, both the laser light passing through the non-conversion region 3B and the illumination light emitted from the conversion region 3A are irradiated on an object. On the other hand, when the switch SW is not in an on-state (when the switch SW is in an off-state), as illustrated in FIG. 5B, the actuator part 37 slidingly moves the light shielding part 36 so that the reflection portion 36*d* is moved to the front side of the non-conversion region 3B in the light emission direction. At this time, the laser light emitted from the non-conversion region 3B of the phosphor plate 31 is reflected by the reflection portion 36*d* of the light shielding part 36 and is irradiated on the conversion region 3A. The phosphor 35 of the conversion region 3A is excited by the laser light to emit yellow light. This yellow light passes through the transparent base member 36*a* together with the yellow light directly incident on the conversion region 3A from the first optical member 32 and a part of the blue laser light not converted. Then, the yellow light is emitted to the outside of the illumination device 1 through the second optical member 33. According to this configuration, it is possible to suppress irradiation of the laser light on the non-conversion region 3B while reducing a loss of the laser light.

The present invention is not limited to the aforementioned embodiment but may be modified in many different forms. For example, in the aforementioned embodiment, there has been described a configuration example in which one non-conversion region 3B having a circular pinhole shape is formed with respect to the conversion region 3A. However, there may be formed two or more non-conversion regions. Furthermore, the non-conversion region 3B is not limited to the circular shape but may be, for example, a linear shape, a polygonal shape or a symbol shape.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An illumination device, comprising:

a light source configured to emit laser light; and a wavelength converter, including a phosphor plate, configured to convert a wavelength of the laser light emitted from the light source and to irradiate illumination light, wherein the wavelength converter includes a conversion region provided with a phosphor which converts the wavelength of the laser light and emits a wavelength-converted laser light, and a non-conversion region not provided with the phosphor and configured to transmit the laser light emitted from the light source, wherein the phosphor plate includes a substrate and the phosphor, wherein the phosphor is provided on the substrate in a circular film shape when viewed from a front side and is configured to define the conversion region, and wherein the non-conversion region is provided on the substrate in a pinhole shape within the conversion region.

2. The device of claim 1, wherein the non-conversion region is provided on an optical axis of the laser light emitted from the light source and at a center of an irradiation region of the laser light in the wavelength converter.

3. The device of claim 1, further comprising:

a switch configured to permit or inhibit emission of the laser light from the non-conversion region.

4. The device of claim 3, wherein the wavelength converter includes a light shield configured to suppress irradiation of the laser light on the non-conversion region when the switch is turned off.

5. The device of claim 3, wherein the wavelength converter includes an actuator configured to move the non-conversion region outside of an irradiation region of the laser light emitted from the light source, when the switch is turned off.

6. The device of claim 3, wherein the wavelength converter includes a reflector configured to reflect the laser light emitted from the non-conversion region toward the conversion region, when the switch is turned off.

7. An illumination device, comprising:

a laser light source that emits laser light; and a phosphor plate on which the laser light emitted by the light source is incident, the phosphor plate comprising:

a substrate; and a phosphor film provided on the substrate and including a pinhole, wherein the phosphor film converts a wavelength of the laser light incident on the phosphor film, other than the pinhole, and emits a wavelength-converted laser light, and the laser light incident on the pinhole is transmitted through the pinhole without converting the wavelength of the laser light.

* * * * *